United States Patent [19]

Mollica

[11] 4,203,213

[45] May 20, 1980

[54] KNIFE FOR TABLEWARE AND KITCHEN USE

[75] Inventor: Francesco Mollica, Varese, Italy

[73] Assignee: Mollica S.r.l., Varese, Italy

[21] Appl. No.: 921,296

[22] Filed: Jul. 3, 1978

[30] Foreign Application Priority Data

Feb. 17, 1978 [IT] Italy ..... 20391 A/78

[51] Int. Cl.[2] ..... B26B 3/02

[52] U.S. Cl. ..... 30/343; 30/346

[58] Field of Search ..... 30/343, 348, 254, 340, 30/357

[56] References Cited

U.S. PATENT DOCUMENTS

| | | | |
|---|---|---|---|
| 1,864,995 | 6/1932 | Frost | 30/343 X |
| 2,256,769 | 9/1941 | Amrine | 30/343 X |
| 2,520,355 | 8/1950 | Bell | 30/343 X |

FOREIGN PATENT DOCUMENTS

| | | | |
|---|---|---|---|
| 1098692 | 3/1955 | France | 30/343 |
| 1514169 | 6/1978 | United Kingdom | 30/254 |

*Primary Examiner*—Jimmy C. Peters

*Attorney, Agent, or Firm*—Guido Modiano; Albert Josif

[57] ABSTRACT

A knife for tableware and kitchen use comprises a supporting body of plastics material in the shape of a common knife and a metal lamellar insert incorporated in the supporting body and having a cutting edge projecting therefrom.

7 Claims, 12 Drawing Figures

KNIFE FOR TABLEWARE AND KITCHEN USE

BACKGROUND OF THE INVENTION

This invention relates to a knife, and more particularly to a type of knife for all the more common uses, from that of an item of cutlery to be used once and then thrown away, to that of a general kitchen knife.

The development of technology has seen relatively little change in the structure of knives for some centuries past. The greatest innovations are merely the introduction of stainless steel and serrated blades. In fact, recently, certain sophisticated knife blades have disappeared, and the available range has been reduced, because of the increasingly widespread introduction of slicing machines in the family kitchen. However, new requirements have arisen. Meals on journeys, in trains or aeroplanes, meals during meetings of employees or members of organizations, and meals in the open air all require for their proper comfort the provision of a set of cutlery which can be disposed of after use, and this in certain cases costs less than collecting and washing conventional cutlery.

This has led to the development of plastic cutlery to be disposed of after use, and provided in sealed packages to ensure their hygiene. However, plastic knives at present available for this use are not suitable for the functions which they are required to perform. Plastic is not suitable for knives in that it does not cut. It would be possible to manufacture knives of a special plastic offering a certain cutting power for a short period, but the cost would no longer be economical.

There are also many other uses for which it would be advantageous to provide a general knife with a metal cutting edge which is of immediate use and of low cost, of the same order as plastic knives. An example of such a use is where normal knives are easily broken or lost.

A clear idea of the supply and demand situation can be obtained from figures given for pure comparison purposes. If it is assumed that a general knife with a metal blade costs one dollar, then it can be assumed that a plastic disposable knife would cost about one cent. There is no knife of an intermediate cost, and preferably close to the minimum value, which, according to the occasion, can either be disposed of or re-used until worn, and which is provided with an effective and reliable cutting edge such as that of a metal blade.

SUMMARY OF THE INVENTION

In general object of the present invention is to make up the said gap in the supply of knives.

A particular object of the invention is a type of knife which economically can be considered on a level with a knife to be used occasionally and then disposed of, but which technically offers a performance similar to that of a common metal knife, and has more uses than this latter.

These and further objects which will be apparent hereinafter are attained by a knife characterized in that it comprises a plastics support member in the shape of a common knife, and a metal lamellar insert incorporated in the support member and having a cutting edge projecting from said member.

BRIEF DESCRIPTION OF THE DRAWINGS

Preferred embodiments of the invention are described hereinafter with reference to the drawings, in which.

DESCRIPTION OF THE PREFERRED EMBODIMENTS

Figure 1:
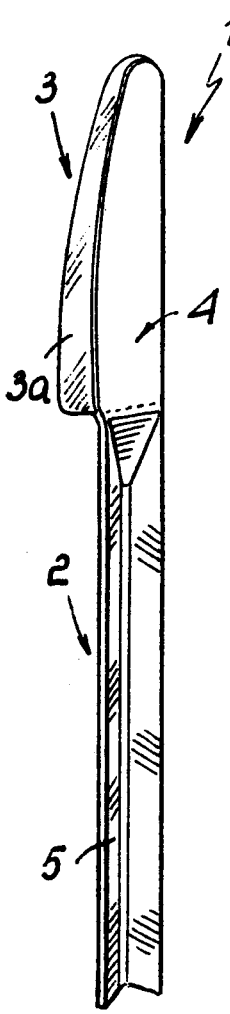
FIG. 1 is a perspective view of a knife according to the invention.
Figure 2:
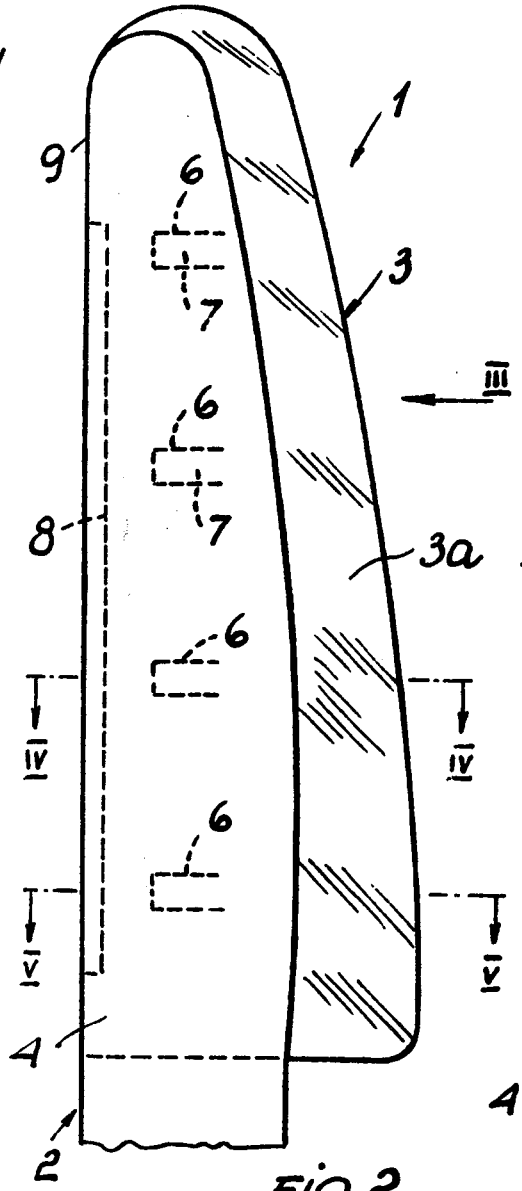
FIG. 2 is a plan view of the part of the knife provided with the blade insert.
Figure 3:
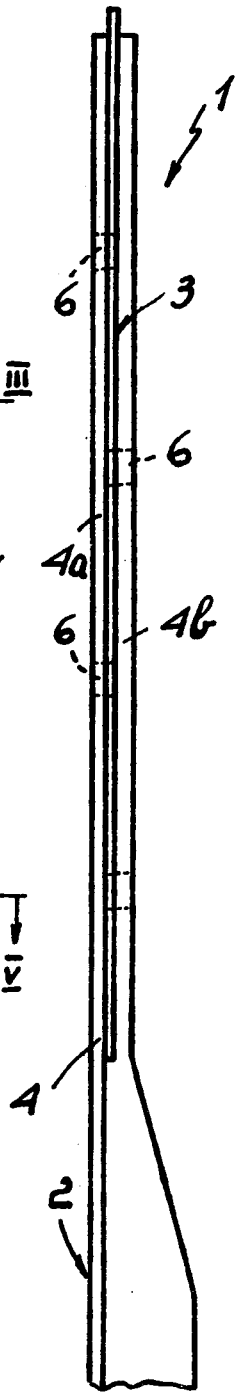
FIG. 3 is an edge view of that part of the knife of FIG. 2.
Figure 5:
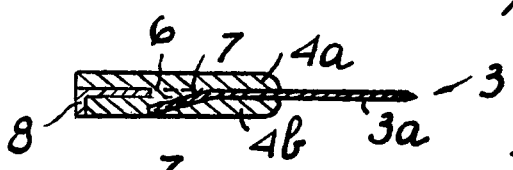
FIG. 5 is a section on the line V—V of FIG. 2.
Figure 4:
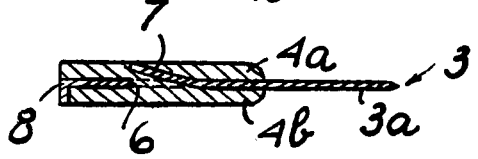
FIG. 4 is a section on the line IV—IV of FIG. 2.
Figure 6:
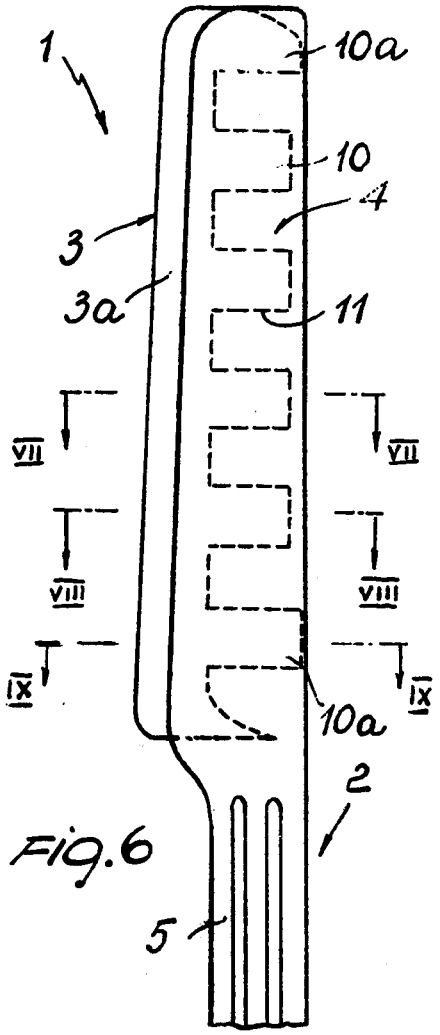
FIG. 6 is a plan view of the part of the knife provided with the blade insert, in accordance with another embodiment of the invention.

In the figures, a knife constructed in accordance with the invention is indicated generally by the reference numeral 1. It is composed of two separate structural parts, namely an elongate support member 2 and an elongate lamellar element or blade 3, which is embedded in a substantially flat elongate holding portion or holder 4 of the member 2, this portion 4 being aligned and integral with an elongate handle portion 5 of a member 2. The metal blade 3 in FIGS. 1 to 5 is inserted into the blade holder 4 and extends over a length substantially corresponding to the length of the holder 4, to form a sandwich with two substantially symmetrical plastics layers 4*a* and 4*b* of the holder 4, which are of equal thickness. The form of the blade is the same as the usual form of a kitchen knife blade and of the most widespread disposable plastics knives. A substantially flat cutting portion of the blade 3, forming a cutting edge 3*a*, projects from the blade holder 4 in a plane substantially parallel to the substantially flat elongate holder 4 along one side thereof, as best visible in FIGS. 1, 2 and 6.

To enable the two layers 4*a* and 4*b* to be physically joined together so as to avoid any danger of one of them accidentally separating from the blade 3 under force, and to firmly hold the blade 3 within the holder 4, rectangular apertures 6 are provided in that part of the blade inserted in the blade holder 4, so that the two plastics layers join together therethrough to form a single body. The tabs 7 obtained by cutting three sides of the apertures 6 are advantageously bent outwards both to leave the apertures 6 free and also to facilitate the centering of the blade 3 during the production stage, as will be seen hereinafter. For this reason, the tabs 7, which extend spaced apart from one another along the length of the blade 3, are bent alternately towards 4*a* (FIG. 4) and towards 4*b* (FIG. 5), i.e. towards opposite faces of the holder 4 with the same inclination and projection. If the sizes used require it, the blade 3 can be stiffened longitudinally by forming a rib 8, by bending a long portion of the blade edge 9 opposite the cutting edge at a right angle with respect to the blade 3, with the advantage of also strengthening the blade holder.

In a knife according to the invention, the support structure is in the form of a common plastics knife, which allows the plastic itself to perform the majority of the mechanical functions, and the inserted blade to perform the cutting function. Thus the blade can be very thin, having a thickness of 0.1 to 0.5 mm and preferably 0.2 mm. The overall thickness of the blade holder 4 is about 3 mm, depending on the force to be exerted by it. If a more rigid and light knife is required, longitudinal ribs can be provided over the entire length of the support member 2. In this case, it must be remembered that the rib 8 also contributes to stiffening the blade, so that a true composite structure results in which the strength of the assembly exceeds the simple sum of the strength of the parts.

FIGS. 6 to 10 show one modified embodiment which gives a substantial saving in steel, and is thus very important when it is required to use blades of stainless or quality steel.

The corresponding parts are indicated by the same reference numerals.

The difference consists in the punching pattern for the blade over that part which is opposite to the cutting edge 3*a* and inserted into the blade holder 4, this part now having a toothed profile with transverse teeth 10, and in the shape of a rectangular fret in the example.

Figure 7:
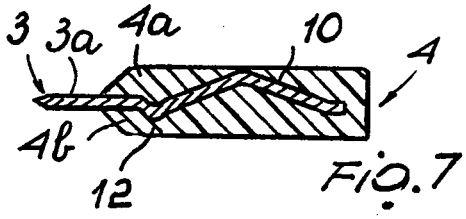
FIGS. 7, 8 and 9 are sections on the lines VII—VII VIII—VIII, IX—IX of FIG. 6, respectively.
Figure 8A:
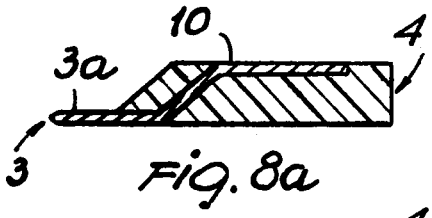
FIGS. 8*a* and 9*a* are sections on the lines VIII—VIII and IX—IX of a further embodiment of the invention.
Figure 8:
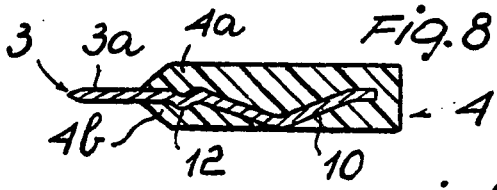
Figure 9A:
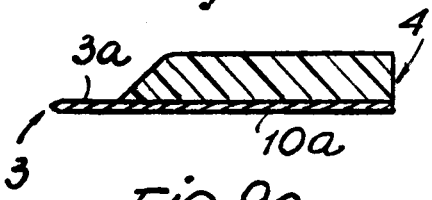
Figure 9:
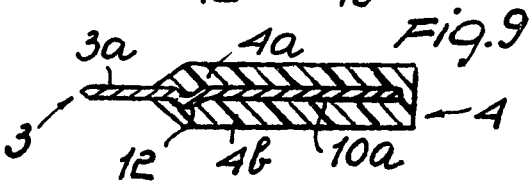

The teeth 10, spaced apart by equal spaces 11, provide a fixing in the blade holder 4 which is just as reliable as the apertures 6. To centre the blade in the mould, the teeth 10 in the embodiment of FIGS. 7 and 8 are bent as a V pointing alternatively in opposite directions towards the layer 4*a* and towards the layer 4*b*. The vertex of each V is dimensioned so that it reaches and lies tangentially to a main face of the blade holder and therefore presses lightly against the walls of the mould, to centre the blade therein. Only two end teeth 10*a* (FIG. 9) are not bent in the form of a V, so as to provide a plane reference in the mould. Alternatively, in accordance with the embodiment of FIGS. 8*a* and 9*a*, the teeth 10 and 10*a* can be bent to define opposing surface portions of the main faces of the blade holder 4, the cutting edge 3*a* can be a direct extension of one main face of the blade holder 4, being substantially aligned with this face.

A longitudinal rib 12 (FIGS. 7, 8 and 9) can be suitably provided to stiffen the blade longitudinally.

Figure 10:
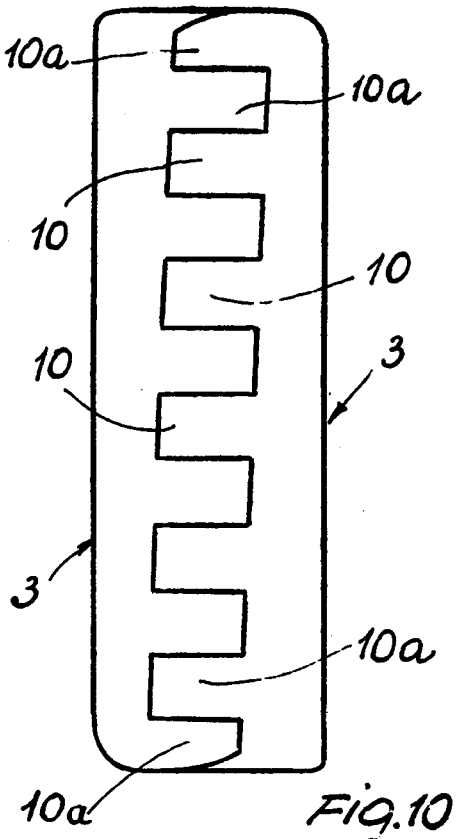
FIG. 10 shows a punching pattern for a pair of blades.

FIG. 10 shows how a pair of blades 3 with mating teeth 10 can be marked off and punched from one sheet, with an obvious saving in material. From the example, it can be seen that each blade can have a plan profile which partly converges towards the point, without loss of material, the two blades being mutually inverted when cut.

The proposed structure is the result of a study with the object of combining functional merits with ease of the production process, this constituting a further characteristic of the invention. The knife heretofore described is manufactured in the following stages. The blades 3 complete with the apertures 6 and bent rib piece 8 are punched and formed in a single blow from a thin sheet. The blade 3 is transferred from the punching mould preferably automatically, for example by an expeller and chute, into a plastics injection die-casting mould, in which the blade is incorporated.

The tabs 7 or teeth 10, bent as shown in the figures, serve both to make the joint between a blade and its blade holder more stable and also to perfectly centre the blade in the mould, without other spacers having to be positioned each time in the mould. The knife can be considered finished after the injection operation. In this respect, the particular structure makes it possible to choose a blade which is so thin as not to need sharpening either at the beginning or during use, it remaining permanently sharp with wear, especially when the cutting edge is provided serrated.

If required, the knife can be finished in a wash and passivation bath, in which the blade receives a brilliant lustre and an anticorrosive protection, at least for the time for which it is kept in store.

In practice, the entire process can be made completely automatic.

The description has demonstrated in the most apparent manner that the objects of the invention have been completely attained, and in addition other important advantages have been provided such as a simplified method of manufacture which can be automated with the maximum facility, continual sharpening, and an improved rigidity, although using very flexible common steels. In particular, it will be apparent to the expert that although the cost of the knife according to the invention is greater than the cost of knives constructed completely of plastics, the increase is only a fraction of the cost of an analogous knife without the insert. Thus, the total cost is of the same order of magnitude. Moreover, the actual value and quality of the knife according to the invention raise it into a class which is distinctly superior to that of the type with which it has been compared, and very close if not equal to a common economical kitchen knife. In fact, from some aspects, it is superior, for example for its durable sharpening.

From the original proposed structure, it is easy to deduce modified forms and find different special uses. For example, the cutting edge can be serrated , or, if supplied in a sterile wrapper, the knife could act as a lancet to be used for a single operation, because its cost as constructed, even incorporating a quality blade, would be less than a normal sterilization operation, and would give better guarantees.

Similar derivations or extrapolations fall within the protective scope of the invention as claimed in the appended claims.

I claim:

1. A knife comprising an elongate support member made of plastic material and including an elongate handle portion and a substantially flat elongate holding portion aligned and integral therewith, an elongate lamellar element made of metal and extending over a length substantially corresponding to the length of said elongate holding portion, said lamellar element being embedded in said holding portion and having a substantially flat cutting portion projection from said holding portion in a plane substantially parallel to said substantially flat elongate holding portion along one side thereof to define a cutting edge, and means for firmly holding said lamellar element within said elongate holding portion.

2. A knife as claimed in claim 1, wherein said means comprise tabs bent away from said lamellar element, said tabs being bent alternately toward opposite faces of said holding portion and extending spaced apart from one another along said length of said lamellar element.

3. A knife as claimed in claim 1, wherein said lamellar element has an edge opposite to said cutting edge and bent at a right angle with respect to said substantially flat cutting portion.

4. A knife as claimed in claim 1, wherein said lamellar element has a toothed profile opposite to said cutting edge and arranged within said holding portion, said toothed profile comprising teeth and spaces therebetween having equal shapes.

5. A knife as claimed in claim 4, wherein said teeth are bent in the form of a V and wherein adjacent teeth are bent in opposite directions, each V having a vertex tangential to a main face of said holding portion.

6. A knife as claimed in claim 4, wherein said teeth are bent away from said lamellar element and have flat portions defining surface portions of main opposite faces of said holding portion.

7. A knife as claimed in claim 6, wherein said lamellar element has a substantially flat portion defining a cutting edge projecting from said holding portion and arranged substantially aligned with one of said main faces of said holding portion.

* * * * *